US007861378B2

(12) United States Patent
Neukötter

(10) Patent No.: US 7,861,378 B2
(45) Date of Patent: Jan. 4, 2011

(54) HINGE PLATE FOR CONCEALED PLACEMENT BETWEEN DOOR FRAME AND DOOR

(75) Inventor: Hubert Neukötter, Beelen (DE)

(73) Assignee: Simonswerk, Gesellschaft mit beschränkter Haftung, Rheda-Wiedenbrück (DE)

( * ) Notice: Subject to any disclaimer, the term of this patent is extended or adjusted under 35 U.S.C. 154(b) by 0 days.

(21) Appl. No.: 11/058,338

(22) Filed: Feb. 15, 2005

(65) Prior Publication Data

US 2005/0198778 A1 Sep. 15, 2005

(30) Foreign Application Priority Data

Mar. 11, 2004 (DE) ..... 10 2004 012 350

(51) Int. Cl.
*E05D 3/06* (2006.01)
*E05D 7/04* (2006.01)
*E05D 15/00* (2006.01)

(52) U.S. Cl. ..... 16/366; 16/237; 16/243; 16/368; 16/242

(58) Field of Classification Search ..... 16/366, 16/368, 235–237, 242, 243
See application file for complete search history.

(56) References Cited

U.S. PATENT DOCUMENTS

| | | | | | |
|---|---|---|---|---|---|
| 1,126,764 | A | | 2/1915 | Hubbard | |
| 1,484,093 | A | | 2/1924 | Soss | |
| 1,797,802 | A | * | 3/1931 | Soss | 16/369 |
| 2,001,356 | A | * | 5/1935 | Bates | 16/358 |
| 2,135,280 | A | * | 11/1938 | Erickson | 16/369 |
| 3,209,390 | A | | 10/1965 | Bassan | |
| 3,881,221 | A | | 5/1975 | Schmidt | |
| 3,886,627 | A | * | 6/1975 | Bassan | 16/387 |
| 3,978,549 | A | | 9/1976 | Vitt | |
| 4,286,353 | A | | 9/1981 | Roche | |
| 4,684,017 | A | * | 8/1987 | Watanabe et al. | 206/235 |
| 4,780,929 | A | | 11/1988 | Burns et al. | |
| 4,843,680 | A | | 7/1989 | Cress et al. | |
| 5,283,929 | A | * | 2/1994 | Lin | 16/237 |
| 5,685,046 | A | * | 11/1997 | Neag et al. | 16/366 |
| 5,720,082 | A | * | 2/1998 | Rossmo | 16/244 |
| 6,487,755 | B1 | | 12/2002 | Caldari | |
| 6,829,808 | B2 | | 12/2004 | Neukötter | |

FOREIGN PATENT DOCUMENTS

| | | |
|---|---|---|
| CH | 671 066 | 7/1989 |
| DE | 1 759 611 | 1/1958 |

(Continued)

*Primary Examiner*—David Reese
(74) *Attorney, Agent, or Firm*—Collard & Roe, P.C.

(57) ABSTRACT

A hinge plate for concealed placement between door frame and door panel, has two mounting bases that can be set into recesses in the door frame and in the door panel, and hinge brackets that work together in pairs, which are connected to rotate about a vertical axis of rotation. On the mounting bases, in each instance, the end of one hinge bracket is mounted to rotate about a vertical axis of rotation, and the end of the other hinge bracket is guided to move longitudinally. The hinge brackets are structured as connection elements having the same construction, which have a U shape with a connecting stay and vertically oriented shanks The hinge brackets are joined together in the manner of a plug-in connection, and are connected to rotate at the connecting stays.

3 Claims, 3 Drawing Sheets

FOREIGN PATENT DOCUMENTS

| | | |
|---|---|---|
| DE | 1 559 963 | 12/1969 |
| DE | 201 14 399 | 1/2002 |
| DE | 202 13 155 | 12/2002 |
| EP | 1 063 376 | 12/2000 |
| FR | 906.703 | 1/1946 |
| GB | 513 792 | 10/1939 |
| GB | 1 048 526 | 11/1966 |
| GB | 2 032 994 | 5/1980 |
| JP | 5113068 | 5/1993 |
| JP | 6288139 | 10/1994 |

* cited by examiner

HINGE PLATE FOR CONCEALED PLACEMENT BETWEEN DOOR FRAME AND DOOR

CROSS REFERENCE TO RELATED APPLICATIONS

Applicant claims priority under 35 U.S.C. §119 of German Application No. 10 2004 012 350.0 filed Mar. 11, 2004.

BACKGROUND OF THE INVENTION

1. Field of the Invention

The present invention relates to a hinge plate for concealed placement between door frame and door panel. The hinge plate has two accommodation bodies or mounting bases that can be set into recesses in the door frame and in the door panel, and hinge brackets or shackles that work together in pairs, which are connected to rotate about a vertical axis of rotation.

On the mounting bases, in each instance, the end of one hinge bracket is mounted to rotate about a vertical axis of rotation, and the end of the other hinge bracket is guided to move longitudinally.

2. The Prior Art

A hinge plate having the structure described is known from EP 1 063 376 A2. With this known design, the hinge brackets each extend by half over the vertical section of the hinge plate. In order to adjust the height, the distance between the hinge brackets can be changed. For this purpose, the axis of rotation between the hinge brackets is formed as a setting spindle. The dimensional stability of this known arrangement needs improvement. The hinge plate is suitable for installation on light door panels, for example in the furniture sector.

A hinge plate for concealed placement between door frame and door panel is known from DE-U 202 13 155; this hinge plate is suitable for heavy doors. The hinge shackles or brackets, which are connected with one another so as to rotate, are structured in different ways. One hinge bracket is structured as a fork and has two fork arms that are connected with a rear connection segment. The second hinge bracket is inserted into the free space between the fork arms and has a center piece, mounted to rotate on the fork arms. Connected to the center piece at each of its two ends are broader end segments that project upward and downward. The hinge plate has proven itself in terms of its function. However, the production and installation effort and expenditure are great, since different parts have to be produced, and articulated connections have to be provided at the two fork arms of the one hinge bracket. The placement of bearing bores in the two fork arms and the installation of the related articulated connections requires several processing and handling steps.

SUMMARY OF THE INVENTION

It is an object of the present invention to provide a shape-stable hinge plate for concealed placement between door frame and door panel, which can be produced cost-effectively because of the simplest possible structure.

Proceeding from a hinge plate having the characteristics described initially, these and other objects are achieved by a hinge plate having hinge brackets or shackles in accordance with the invention. The hinge brackets are structured as connection elements having the same construction, namely a U shape with a connecting stay and vertically oriented shanks. The hinge brackets are joined together in the manner of a plug-in connection, and are connected to rotate at the connecting stays. If the connecting stay and the vertically oriented shanks are sized appropriately, the connection elements have a great stiffness, in terms of shape. They bridge the distance between the accommodation bodies or mounting bases and reach directly up to the mounting bases both on the top and at the bottom. In this way, mounting can take place on short pegs that bridge only a short distance gap.

The hinge shackles or brackets, which have the same construction, can be produced as cast parts made of plastic or metal, in cost-effective manner.

The articulated connection between the hinge shackles or brackets is made up of a bushing and a pin that can be inserted into the bushing. According to a preferred embodiment of the invention, the connecting stay of the hinge bracket contains a bore into which the bushing or the pin can optionally be set. The bore can be configured as a dead-end bore, in which the bushing or the pin, respectively, is disposed so as not to fall out.

In another embodiment, the axles mounted on the mounting bases have a two-axle offset relative to one another in the case of an opening movement of the hinge plate. This offset is present in all functional positions of the hinge plate. In this way, an undesirable tipping movement of the door panel can be avoided, particularly in the open position of the hinge plate.

The longitudinal guide provided on the mounting bases can be disposed orthogonal to the front side of the accommodation body. A better utilization of the available installation space is possible, however, if the longitudinal guide provided on the mounting bases is oriented at a slant.

It is practical if adjustable inserts are disposed in the mounting bases, on which the ends of the hinge bows are mounted and guided to move longitudinally. The adjustability of the inserts can be utilized for two-dimensional or three-dimensional adjustment of the hinge plate. According to a preferred embodiment, the inserts of one mounting base are disposed in a guide recess of the mounting base, so as to be horizontally or vertically adjustable or both. The inserts of the other mounting base are adjustable orthogonal to its front side.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
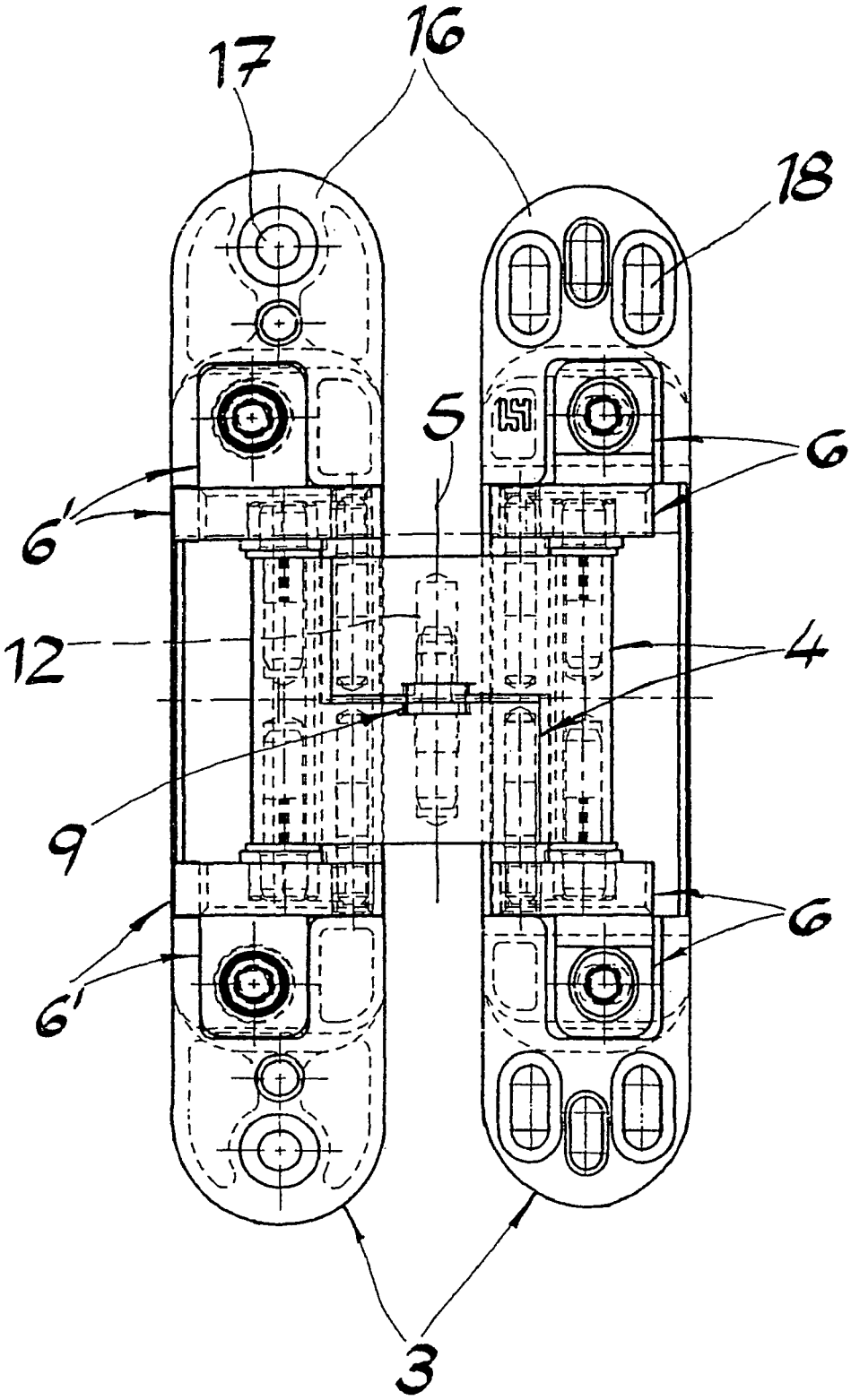
FIG. 1 shows a hinge plate for concealed placement, for door frame and door panel.

Referring now to the drawings, the hinge plate shown serves to hold a door panel 1 on a door frame 2, so as to pivot. When the door is closed, the hinge plate is disposed in concealed manner. It is suitable for room doors in residential spaces.

The basic structure of the hinge plate shown in the drawings includes two accommodation bodies or mounting bases 3 and two hinge shackles or brackets 4. Mounting bases 3 can be set into recesses in door frame 2 and door panel 1. Hinge brackets 4 cooperate with each other in pairs and are connected so as to rotate or pivot about a vertical axis of rotation 5. Inserts 6, 6' are disposed in mounting bases 3, on which inserts the end of one hinge bracket is mounted to rotate about a vertical axis of rotation, and the end of the other hinge bracket is guided to move longitudinally, in each instance.

Figure 3:
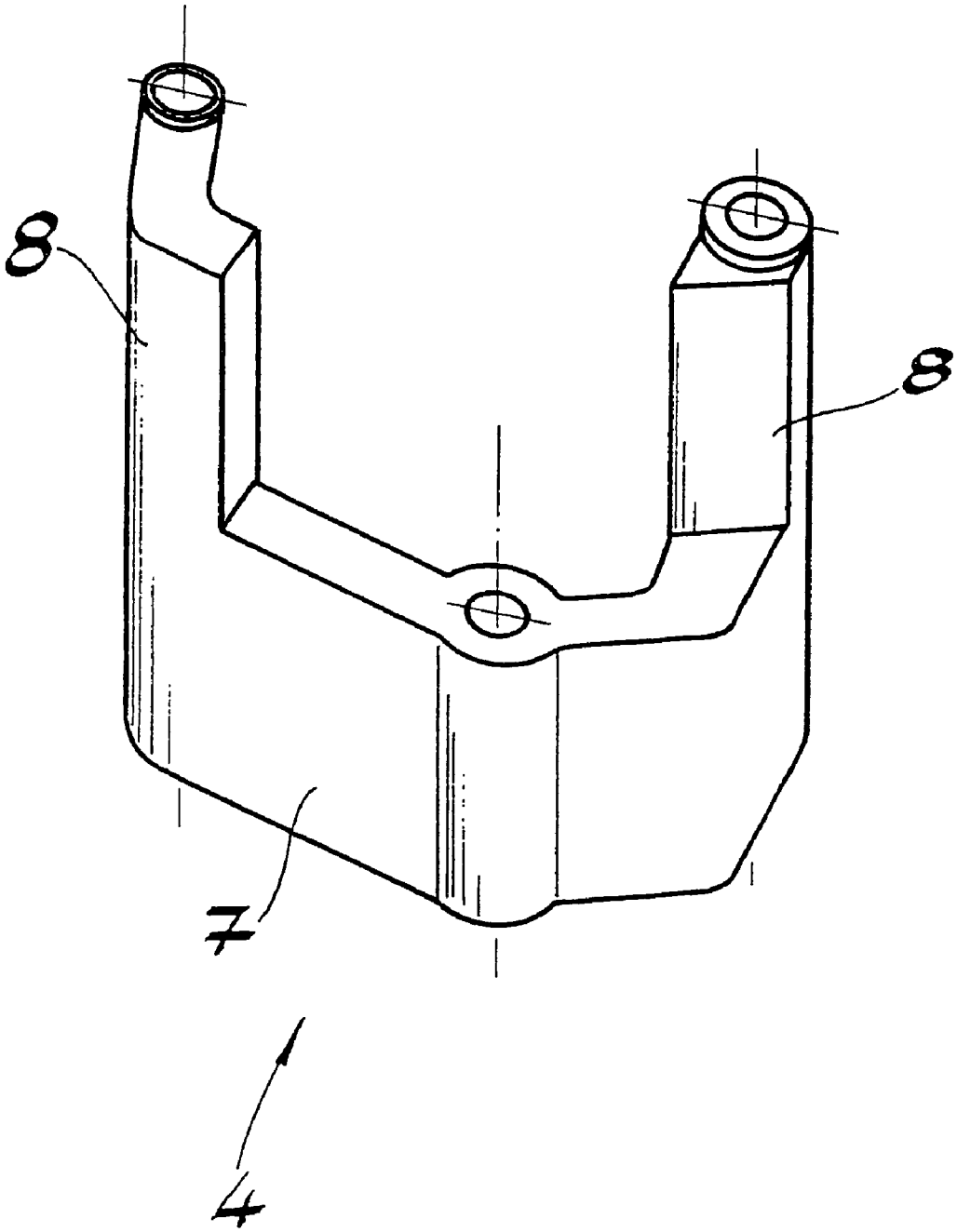
FIG. 3 shows an individual part drawing of a hinge shackle.

A comparison of FIGS. 1 and 3 shows that the hinge shackles or brackets 4 are configured as connection elements having the same construction, which have a U shape with a connecting stay 7 and two shanks 8 oriented vertically. Hinge brackets 4 are joined together in the manner of a plug-in connection, and are connected to rotate at connecting stays 7. They can be produced as cast parts made of plastic or metal.

The articulated connection 9 between hinge shackles or brackets 4 is made up of a bushing and a pin that can be inserted into the bushing. Connecting stay 7 of hinge brackets 4 contains a bore 12 into which the bushing or the pin can optionally be set. In the exemplary embodiment, bore 12 is configured as a dead-end bore in which the bushing or the pin, respectively, is disposed so as not to fall out.

Figure 2:
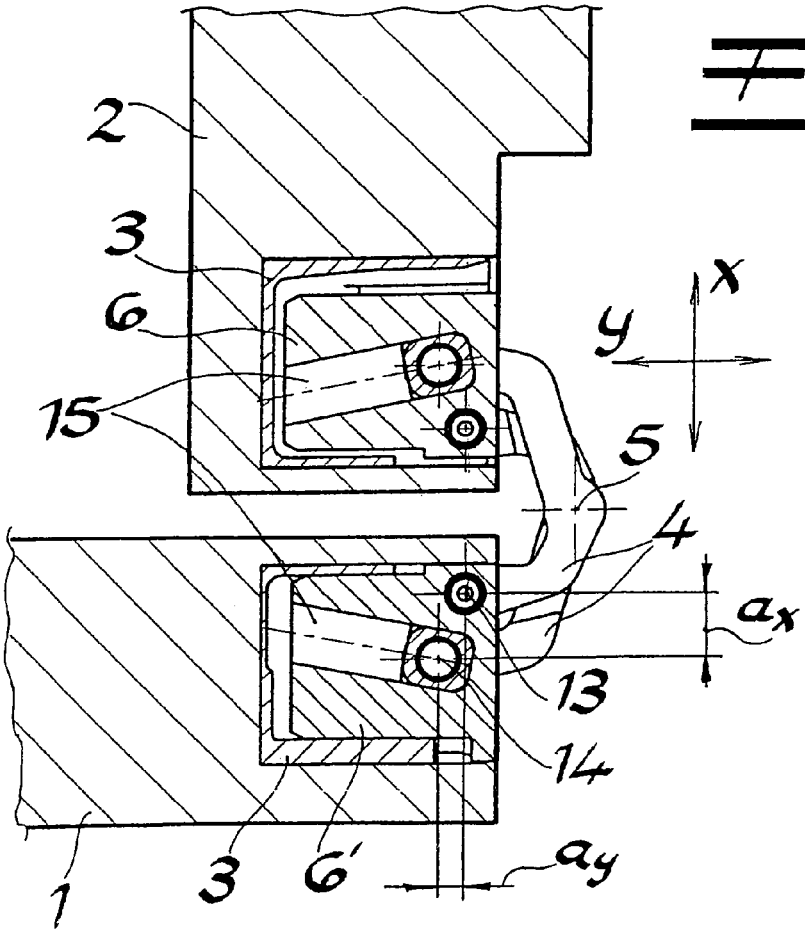
FIG. 2 shows a top view of the hinge plate shown in FIG. 1, with the door open.

It is evident from FIG. 2 that the axles 13, 14 mounted on mounting bases 3 have a two-axle offset $a_x$, $a_y$ relative to one another in the case of an opening movement of the hinge plate, in all functional positions. In particular, this offset is present also in the open position shown in FIG. 2. The two-axle offset $a_x$, $a_y$ contributes to preventing undesirable tipping movements of the open door panel 1 from taking place. It is furthermore evident from FIG. 2 that for better utilization of the installation space, the longitudinal guide 15 provided on mounting bases 3 is oriented at a slant.

In the exemplary embodiment, inserts 6 of the one mounting base are disposed to be horizontally adjustable in a guide recess of mounting base 3. Inserts 6' of the other mounting base are adjustable orthogonal to its front side. By means of adjusting inserts 6, 6', door panel 1 can be adjusted in the axis directions X and Y.

Mounting bases 3 have a front-side attachment flange 16 having bores 17, 18 for a screw attachment. In the exemplary embodiment, oblong holes 18 are provided in the attachment flange of a mounting base. In this way, a height adjustment on door frame 2 or door panel 1 is possible.

By means of the different adjustment possibilities, adjustments of the door panel with regard to height can be made, and alignment errors between the door panel and the door frame in the closed state can be corrected. All of the adjustments can be made from the front side, and therefore in the installed state of the hinge plate.

Although only at least one embodiment of the present invention has been shown and described, it is to be understood that many changes and modifications may be made thereunto without departing from the spirit and scope of the invention as defined in the appended claims.

What is claimed is:

1. A hinge plate for concealed placement between a door frame and a door panel comprising:

(a) first and second mounting bases for insertion into recesses in the door frame and in the door panel;

(b) first and second cooperating hinge brackets connected to rotate about a first vertical axis of rotation; and (c) a longitudinal guide provided on each of said first and second mounting bases;

wherein on each of said first and second mounting bases, an end of said first hinge bracket is mounted to rotate about a second vertical axis of rotation and an end of said second hinge bracket is guided to move longitudinally in said longitudinal guide, said first and second hinge brackets forming identical in a view parallel to the vertical axes U-shaped connection elements, each connection element consisting of two vertically oriented shanks and a single connection stay between said shanks;

wherein the hinge brackets have an articulated connection comprising a bushing and a pin insertable into the bushing, and each connection stay contains a dead-end bore for receipt of the bushing or the pin, so that said first and second hinge brackets plug into each other for rotation at the connection stays; and wherein the vertically oriented shanks bridge the distance between the mounting bases and reach directly up to the mounting bases both on the top and on the bottom;

axles mounted on the mounting bases, said axles having a two-axis offset relative to one another when the hinge plate opens, in all functional positions of the hinge plate;

adjustable inserts disposed in the mounting bases, the ends of the hinge brackets being mounted on said inserts and guided to move longitudinally; and wherein the inserts of the first mounting base are disposed in a guide recess of said first mounting base, so as to be horizontally or vertically adjustable, and the inserts of the second mounting base are disposed to be adjustable orthogonal to a front side of said second mounting base.

2. The hinge plate as recited in claim 1, wherein the hinge brackets comprise cast parts made of plastic or metal.

3. The hinge plate as recited in claim 1, wherein said longitudinal guide provided on each mounting base is relative to a front side of the mounting bases oriented at a slant, for better utilization of installation space.

* * * * *